US008535095B2

(12) United States Patent
Youn et al.

(10) Patent No.: US 8,535,095 B2
(45) Date of Patent: Sep. 17, 2013

(54) CLIP-TYPE ELASTIC CONTACT PIECE AND SHIELDED CONNECTOR HOUSING ASSEMBLY HAVING THE SAME

(75) Inventors: Bok-Hee Youn, Incheon (KR); Yong-Joon Noh, Anyang-si (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 145 days.

(21) Appl. No.: 13/145,715

(22) PCT Filed: Dec. 29, 2009

(86) PCT No.: PCT/KR2009/007879

§ 371 (c)(1),
(2), (4) Date: Sep. 23, 2011

(87) PCT Pub. No.: WO2010/085049

PCT Pub. Date: Jul. 29, 2010

(65) Prior Publication Data

US 2012/0015549 A1 Jan. 19, 2012

(30) Foreign Application Priority Data

Jan. 22, 2009 (KR) ..... 10-2009-0005680
Feb. 5, 2009 (KR) ..... 10-2009-0009421

(51) Int. Cl.
*H01R 13/648* (2006.01)

(52) U.S. Cl.
USPC ..... 439/607.17

(58) Field of Classification Search
USPC ..... 439/607.17, 607.19, 607.01, 374; 24/295, 627
See application file for complete search history.

(56) References Cited

U.S. PATENT DOCUMENTS

| | | | | | |
|---|---|---|---|---|---|
| 2,658,247 | A | * | 11/1953 | Heuer | 248/73 |
| 2,920,245 | A | * | 1/1960 | Anderson et al. | 361/807 |
| 4,812,137 | A | * | 3/1989 | Wilson et al. | 439/607.17 |
| 4,842,554 | A | * | 6/1989 | Cosmos et al. | 439/607.17 |
| 4,842,555 | A | * | 6/1989 | Cosmos et al. | 439/607.17 |
| 4,925,400 | A | * | 5/1990 | Blair et al. | 439/374 |
| 5,035,650 | A | * | 7/1991 | Defibaugh et al. | 439/607.17 |

(Continued)

FOREIGN PATENT DOCUMENTS

| | | |
|---|---|---|
| JP | 3869630 | 10/2006 |
| JP | 2007-157579 | 6/2007 |
| KR | 10-1998-0064061 | 10/1998 |
| KR | 20-0441681 | 9/2008 |

OTHER PUBLICATIONS

Korean Intellectual Property Office, International Search Report for International Application No. PCT/KR2009/007879, Aug. 13, 2010.

*Primary Examiner* — Amy Cohen Johnson
*Assistant Examiner* — Vladimir Imas
(74) *Attorney, Agent, or Firm* — Sherr & Jiang, PLLC

(57) ABSTRACT

A clip-type elastic contact piece is mounted to a mount portion formed at a metal housing of a shielded connector for the connection with a counterpart metal housing of a counterpart shielded connector to be coupled with the shielded connector. The clip-type elastic contact piece has a flat plate having a predetermined length. An elastic part is formed by bending one side of the flat plate in a length direction of the flat plate so as to be elastically deformable. The elastic part is spaced apart from a front side of the flat plate based on the bent portion, and the spaced distance is partially smaller than a thickness of the mount portion.

14 Claims, 4 Drawing Sheets

(56) References Cited

U.S. PATENT DOCUMENTS

| | | | | |
|---|---|---|---|---|
| 5,035,651 | A * | 7/1991 | Dixon et al. | 439/607.17 |
| 5,041,022 | A * | 8/1991 | Sekiguchi | 439/607.17 |
| 5,277,608 | A * | 1/1994 | Oda | 439/188 |
| 5,454,735 | A * | 10/1995 | Nelson | 439/578 |
| 5,537,294 | A * | 7/1996 | Siwinski | 361/753 |
| 5,539,962 | A * | 7/1996 | Lee | 24/453 |
| 5,647,754 | A * | 7/1997 | Kohno | 439/188 |
| 5,775,930 | A | 7/1998 | Model et al. | |
| 5,934,939 | A * | 8/1999 | Thenaisie et al. | 439/607.53 |
| 5,975,957 | A * | 11/1999 | Noda et al. | 439/607.19 |
| 6,042,414 | A * | 3/2000 | Kunert | 439/374 |
| 6,302,739 | B1 * | 10/2001 | Deno et al. | 439/607.17 |
| 6,485,315 | B1 * | 11/2002 | Hwang | 439/108 |
| 6,532,155 | B2 * | 3/2003 | Green et al. | 361/733 |
| 6,648,665 | B1 * | 11/2003 | Wu | 439/352 |
| 6,843,677 | B2 * | 1/2005 | Fukuda | 439/374 |
| 6,868,588 | B2 * | 3/2005 | Dickinson et al. | 24/295 |
| 6,884,094 | B1 * | 4/2005 | Bernhart et al. | 439/101 |
| 6,890,192 | B2 * | 5/2005 | Riku | 439/108 |
| 6,928,705 | B2 * | 8/2005 | Osterland et al. | 24/295 |
| 7,083,459 | B1 * | 8/2006 | Wu et al. | 439/354 |
| 7,211,739 | B1 * | 5/2007 | Brigham et al. | 174/359 |
| 7,219,404 | B2 * | 5/2007 | Haga et al. | 24/458 |
| 7,258,569 | B1 * | 8/2007 | Johnson et al. | 439/378 |
| 7,438,564 | B2 * | 10/2008 | Lloyd | 439/92 |
| 7,506,414 | B2 * | 3/2009 | Dubost et al. | 24/293 |
| 7,530,858 | B2 * | 5/2009 | Ma et al. | 439/817 |
| 7,637,768 | B1 * | 12/2009 | Hsu | 439/377 |
| 7,640,635 | B2 * | 1/2010 | Kim et al. | 24/295 |
| 7,679,568 | B2 * | 3/2010 | Nilsson et al. | 343/702 |
| 7,850,471 | B2 * | 12/2010 | Imai | 439/188 |
| 7,914,328 | B2 * | 3/2011 | Tanaka et al. | 439/607.08 |
| 8,202,112 | B2 * | 6/2012 | Gabrielson | 439/507 |
| 2007/0128932 | A1 | 6/2007 | Ohtaka et al. | |

* cited by examiner

CLIP-TYPE ELASTIC CONTACT PIECE AND SHIELDED CONNECTOR HOUSING ASSEMBLY HAVING THE SAME

CROSS REFERENCE TO PRIOR APPLICATIONS

This application is a National Stage Patent Application of PCT International Patent Application No. PCT/KR2009/007879 (filed on Dec. 29, 2009) under 35 U.S.C. §371, which claims priority to Korean Patent Application Nos. 10-2009-0005680 (filed on Jan. 22, 2009) and 10-2009-0009421 (filed on Feb. 5, 2009), which are all hereby incorporated by reference in their entirety.

TECHNICAL FIELD

The present invention relates to a clip-type elastic contact piece and a shielded connector housing assembly having the same. More particularly, the present invention relates to a clip-type elastic contact piece and a shielded connector housing assembly having the same, which has a simple structure allowing easy fabrication, prevents abrasion of a metal housing and plastic deformation of the elastic contact piece due to excessive contact of the elastic contact piece, and ensures a waterproof sealing not to be taken off to ensure stable contact of a terminal installed at an inner side of an inner housing.

BACKGROUND ART

Recently, vehicles are digitalized using a plurality of electronic components and sensors, which are electrically connected to cables and also to controllers, drives and power sources via the cables to transfer control signals or power. During such a transfer process, electronic waves are irregularly generated due to electric signals, and accordingly malfunctions happen in sensors or electronic devices controlled by minute signals, which may cause a car accident.

In order to prevent a malfunction caused by such electronic waves, a shielded connector installed to a harness of a vehicle and a shielded connector installed to a unit of the vehicle are generally electrically connected to realize a shielding function. In other words, a metal housing of a shielded connector is contacted with a counterpart metal housing of a counterpart shielded connected to ensure electric connection between them. In more detail, a metal housing is assembled between an inner housing and an outer housing, integrated with each other, to configure a shielded connector. At this time, an elastic contact piece is installed to the metal housing to ensure reliable contact with a counterpart metal housing. Also, a waterproof sealing is installed between the metal housing and the outer housing to prevent water from penetrating into the shielded connector.

However, a common elastic contact piece installed to the metal housing may be worn away due to various vibration conditions of the shielded connector, and also the metal housing contacted with the elastic contact piece may be worn away.

In addition, the elastic contact piece may be plastically deformed due to such excessive contacts and vibrations.

Moreover, a structure for fixedly installing the elastic contact piece to the metal housing is complicated.

Meanwhile, in a shielding structure using the above shielded connector, the shielded connector has a complicated structure, and a ground connection of a cable installed to the shielded connector is very complicated. To solve this problem, the inner housing and the outer housing are separately fabricated in some cases.

However, in such a case, three components such as the inner housing, the outer housing and the metal housing are assembled, which generates tolerances necessary for coupling them, and each housing is severely shaken due to vibration conditions of the vehicle. Accordingly, vibration stresses are applied to connection terminals mounted in the inner housing for electrical connection, which results in unstable electric connection, and therefore the connection terminal may be worn away or deteriorated. Also, the vibrations may separate the inner housing from the metal housing.

In addition, water should not be introduced into the shielded connector by means of the sealing mounted to an outer periphery of the metal housing. However, as the outer housing made of insulating plastic material is deformed due to heat or vibrations, the waterproof structure may be broken, which may allow introduction of water into the shielded connector.

DISCLOSURE OF INVENTION

Technical Problem

The present invention is designed to solve the problems of the prior art, and therefore it is an object of the present invention to provide a clip-type elastic contact piece, which has a simple structure allowing easy fabrication and prevents abrasion of a metal housing and the elastic contact piece as well as plastic deformation of the elastic contact piece due to excessive contact of the elastic contact piece; and a shielded connector housing assembly having the same.

Another object of the present invention is to provide a clip-type elastic contact piece, which may be easily fabricated due to a simple assembling structure of an inner housing, an outer housing and a metal housing, couples the housings such that a waterproof sealing mounted to the metal housing is not easily taken off, and thus improves vibration resistance to ensure stable connection of the connection terminal in spite of vibrations of a vehicle, thereby preventing deterioration caused by vibrations; and a shielded connector housing assembly having the same.

Solution to Problem

In order to accomplish the above object, the present invention provides a clip-type elastic contact piece, which is mounted to a mount portion formed at a metal housing of a shielded connector for the connection with a counterpart metal housing of a counterpart shielded connector to be coupled with the shielded connector, the clip-type elastic contact piece including a flat plate having a predetermined length; and an elastic part formed by bending one side of the flat plate in a length direction of the flat plate so as to be elastically deformable, wherein the elastic part is spaced apart from a front side of the flat plate based on the bent portion, and the spaced distance is partially smaller than a thickness of the mount portion.

Preferably, the elastic part has a plurality of slits formed in a length direction thereof such that the elastic part is partitioned into a contact elastic part and a mount elastic part.

Preferably, the elastic part has two slits formed in the length direction thereof such that the contact elastic piece formed between the slits comes into a contact with the counterpart metal housing of the counterpart shielded connector, and the mount elastic parts formed by the slits at both sides of the contact elastic part are spaced apart from the front side of the flat plate based on the bent portion such that the spaced distance is smaller than a thickness of the mount portion.

Preferably, the contact elastic part is gradually distanced from the front side of the flat plate along the length direction of the flat plate based on the bent portion and the gradually approaches the front side of the flat plate again after passing over a peat point.

Preferably, a projection is formed at the peat point of the contact elastic part and protrusive in a direction opposite to the front side of the flat plate.

In another aspect of the present invention, there is also provided a shielded connector housing assembly, which includes an inner housing into which a cable terminal is inserted; a metal housing partially inserted into a counterpart metal housing, the metal housing having mount portions formed at both sides of a front portion thereof, the metal housing being coupled with the inner housing; and a clip-type elastic contact piece having a flat plate with a predetermined length and an elastic part formed by bending one side of the flat plate so as to be elastically deformable, the clip-type elastic contact piece being inserted into and mounted to the mount portions, wherein the elastic part is spaced apart from a front side of the flat plate based on the bent portion, and the spaced distance is partially smaller than a thickness of the mount portion.

Preferably, the shielded connector housing assembly further includes a sealing mounted to an outer periphery of the metal housing and inserted into the counterpart metal housing together with the metal housing, wherein the inner housing supports the sealing not to be moved when coupling with the metal housing, and the sealing is closely adhered to an inner periphery of the counterpart metal housing to give a sealed structure when the metal housing is completely inserted into the counterpart metal housing.

Preferably, the inner housing includes an insert having a slot to which a connection pin is coupled, the insert being inserted into the metal housing; and a cover formed at an outer side of the insert to surround a front outer side of the metal housing such that the sealing inserted into the outer side of the metal housing is not taken off, wherein the cover has a coupling unit to be coupled with the metal housing.

Preferably, the coupling unit has a coupling groove corresponding to a coupling protrusion formed on an outer side of the metal housing such that the coupling groove is coupled with the coupling protrusion, and the coupling unit is elastically deformable such that the coupling protrusion is inserted into the coupling groove when the insert is completely inserted into the metal housing.

Preferably, the coupling unit has a coupling protrusion corresponding to a coupling groove formed in an outer side of the metal housing such that the coupling protrusion is coupled with the coupling groove, and the coupling unit is elastically deformable such that the coupling protrusion is inserted into the coupling groove when the insert is completely inserted into the metal housing.

Preferably, the cover has a deformation prevention groove corresponding to the elastic contact part so as to prevent plastic deformation of the elastic contact part, and the deformation plastic groove is formed to expose the elastic contact part outwards.

Preferably, the elastic piece has a plurality of slits formed in a length direction thereof such that the elastic piece is partitioned into a contact elastic part and a mount elastic part.

Preferably, the elastic part has two slits formed in the length direction thereof such that the contact elastic part formed between the slits comes in contact with the counterpart metal housing of the counterpart shielded connector, and the mount elastic parts formed by the slits at both sides of the contact elastic part are spaced apart from the front side of the flat plate based on the bent portion such that the spaced distance is smaller than a thickness of the mount portion.

Preferably, the contact elastic part is gradually distanced from the front side of the flat plate along the length direction of the flat plate and then gradually approaches the front side of the flat plate after passing a peak point.

Preferably, the contact elastic part has a projection formed at the peak point and protruding in a direction opposite to the front side of the flat plate.

Preferably, a mismatch prevention structure is respectively provided to the insert and the metal housing so as to prevent the insert from being erroneously inserted into the metal housing.

Preferably, the mismatch prevention structure includes a guide projection and a mismatch prevention groove corresponding to each other, and the guide projection is inserted into the mismatch prevention groove when the insert is inserted into the metal housing.

BRIEF DESCRIPTION OF DRAWINGS

Other objects and aspects of the present invention will become apparent from the following description of embodiments with reference to the accompanying drawing in which.

BEST MODE FOR CARRYING OUT THE INVENTION

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
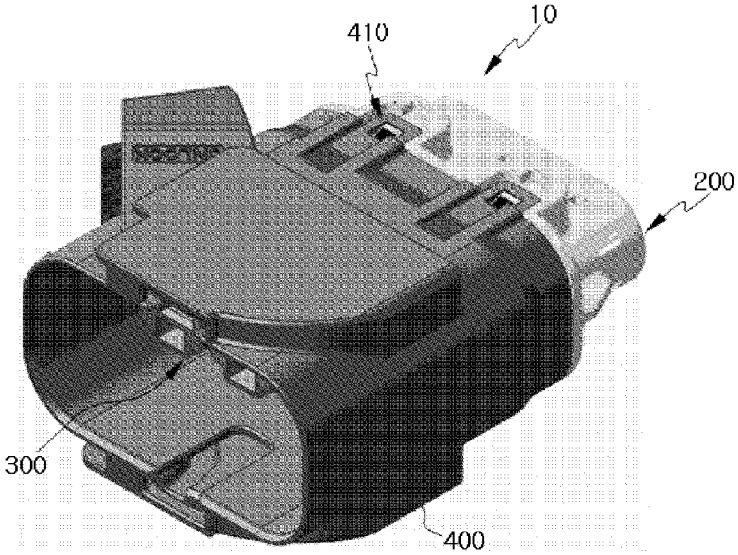
FIG. 1 is a perspective view showing a shielded connector housing assembly according to a preferred embodiment of the present invention.
Figure 2:
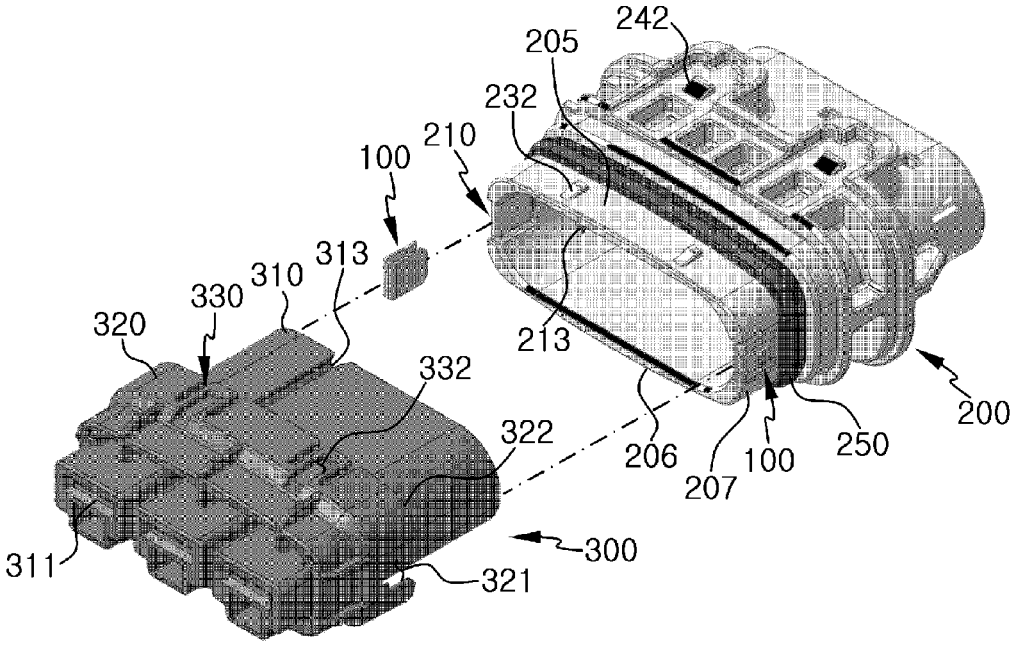
FIG. 2 is a perspective view showing an inner housing and a metal housing employed in the shielded connector housing assembly according to a preferred embodiment of the present invention, which are not yet coupled.
Figure 3:
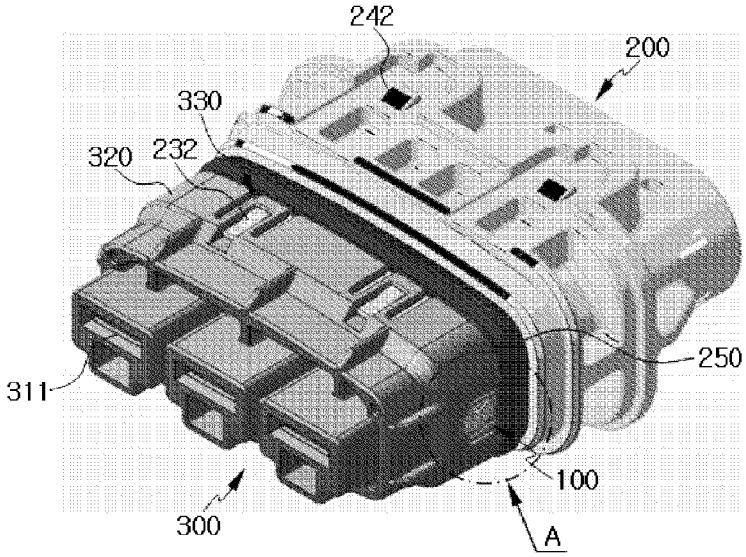
FIG. 3 is a perspective view showing the inner housing and the metal housing of FIG. 2, which are coupled.
Figure 4:
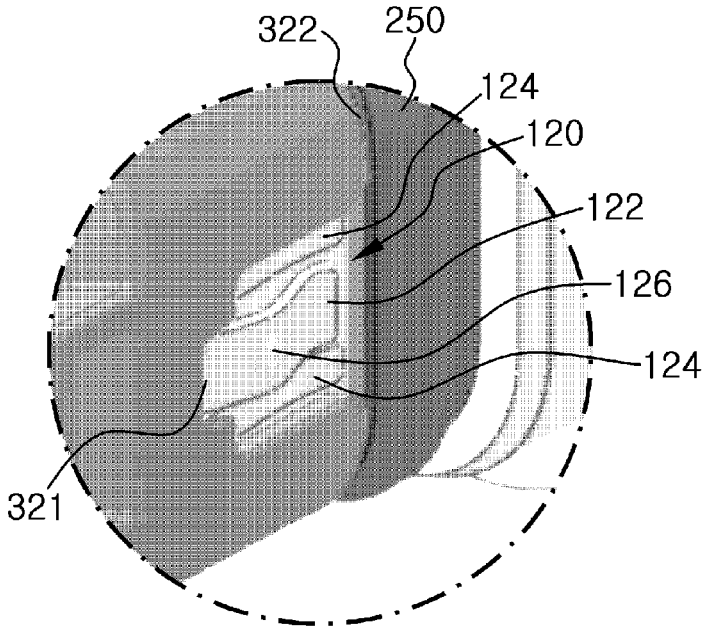
FIG. 4 is an enlarged view showing an A portion of FIG. 3.

FIG. 1 is a perspective view showing a shielded connector housing assembly according to a preferred embodiment of the present invention, FIG. 2 is a perspective view showing an inner housing and a metal housing employed in the shielded connector housing assembly according to a preferred embodiment of the present invention, which are not yet coupled, FIG. 3 is a perspective view showing the inner housing and the metal housing of FIG. 2, which are coupled, and FIG. 4 is an enlarged view showing an A portion of FIG. 3.

Figure 5:
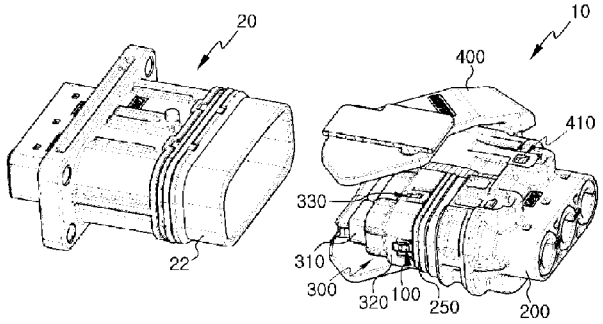
FIG. 5 is a perspective view showing a housing assembly for a waterproof connector according to a preferred embodiment of the present invention, which is not yet coupled to a counterpart connector.

In the present invention, a clip-type elastic contact piece 100 is installed to a metal housing 200 in an easy way to stably contact the elastic contact piece 100 with a counterpart metal housing 22 (see FIG. 5) such that a shielded connector housing assembly 10 may be stably electrically connected to the counterpart metal housing 22 of a counterpart shielded connector 20 (see FIG. 5). Also, the shielded connector housing assembly 10 is configured to have a waterproof structure, thereby improving vibration resistance and ensuring stably coupling.

Referring to the figures, the shielded connector housing assembly 10 includes an inner housing 300 into which a cable terminal (not shown) is inserted, a metal housing 200 having a mount portion 210 at both front sides 207 and coupled with the inner housing 300, a clip-type elastic contact piece 100 inserted into and mounted to the mount portion 210, and an outer housing 400 coupled to the metal housing 200 to surround the inner housing 300 and the metal housing 200.

The shielded connector housing assembly 10 configured as above is installed at a harness and coupled to the counterpart shielded connector 20 installed at a unit of a vehicle such that the elastic contact piece 100 electrically connects the metal housing 200 with the counterpart metal housing 22, thereby performing a shielding function.

The metal housing 200 is a component made of metal, which is designed to shield electric waves of the shielded connector housing assembly 10, and the metal housing 200 is perforated in a length direction to partially receive the inner housing 300 and electrically connected to a braided shielding wire (not shown). This metal housing 200 is preferably made of conductive material by means of die-casting. For example, the metal housing 200 may be made of magnesium, copper, steel or steel alloys.

In more detail, coupling protrusions 232 are formed on an upper surface 205 at a front outer side of the metal housing 200 and on a lower surface 206 at a front outer side thereof, respectively. Here, a front direction of the metal housing 200 means a direction in which the inner housing 300, explained later, is inserted.

Figure 6:
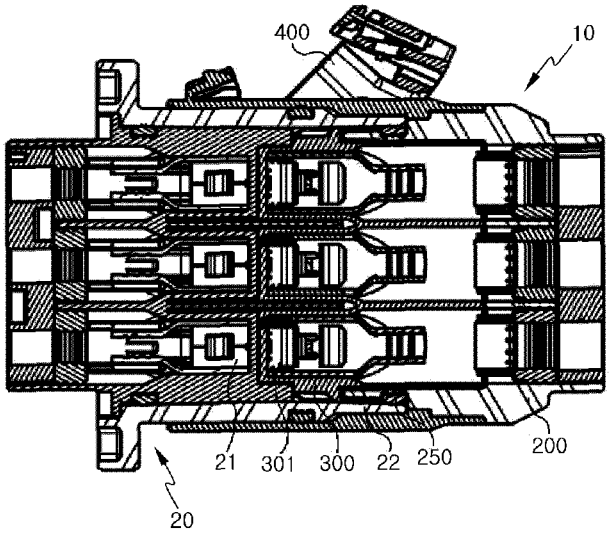
FIG. 6 is a sectional view showing the housing assembly and the counterpart connector of FIG. 5, which are coupled.

Also, the mount portions 210 are formed at both front sides 207 of the metal housing 200 such that the elastic contact piece 100 is installed thereto for contact and electric connection with the counterpart metal housing 22 of the counterpart shielded connector 20. At this time, a part of the metal housing 200 is inserted into the counterpart metal housing 22. In other words, as shown in FIG. 6, a front part of the metal housing 200 is inserted into and installed to the counterpart metal housing 22.

The mount portion 210 is stepped from the front side of the metal housing 200. In other words, the mount portion 210 is formed by depressing outer and inner sides of the metal housing 200 in opposite directions. The clip-type elastic contact piece 100 is mounted to the mount portions 210. The elastic contact piece 100 is protruded out of both sides 207 of the metal housing 200 and elastically deformable to improve reliable contact with the counterpart metal housing 22. The clip-type elastic contact piece 100 will be explained below in more detail.

The coupling protrusions 232 are prepared for coupling with a coupling unit 330 of the inner housing 300, as explained later.

Meanwhile, a sealing 250 having an O-ring shape is mounted on an outer periphery of the metal housing 200. In more detail, the sealing 250 is mounted to a front outer periphery of the metal housing 200, and when the metal housing 200 is inserted into a counterpart metal housing 22, the sealing 250 is also inserted thereto together. In case the metal housing 200 is coupled with the counterpart metal housing 22, the sealing 250 is closely adhered to an inner periphery of the counterpart metal housing 22 to give a sealing structure. Also, the sealing 250 plays a role of preventing impurities or water from penetrating between the metal housing 200 and the counterpart metal housing 22.

As the sealing 250 is located and fixed between the metal housing 200 and the counterpart metal housing 22, a stable waterproof and sealing structure may be maintained, and also it is possible to minimize shaking of the housings 200, 300, 22 due to vibrations. In addition, the metal housing 200 is substantially not deformed due to heat or vibration, so the waterproof may be maintained more stably.

The inner housing 300 is inserted into an front inner portion of the metal housing 200 and coupled to the metal housing 200, and the inner housing 300 is coupled with a connection pin 21 of the counterpart shielded connector 20 installed at a unit of a vehicle. This inner housing 300 should have heat resistance, mechanical strength and electric insulation. The inner housing 300 includes an insert 310 inserted into a front inner portion of the metal housing 200, and a cover 320 formed on an outer side of the insert 310 to surround a front outer side of the metal housing 200. The inner housing 300 may be made by means of injection molding of engineering plastic.

A cable terminal (not shown) is concavely formed in a rear side of the insert 310. In more detail, the insert 310 has a slot 311 into which the connection pin of the counterpart shielded connector 20 is inserted. Also, the insert 310 has an inner configuration for receiving a part of a cable and a connection terminal 301 electrically connected with a bundle of cables (not shown). The connection pin 21 is inserted into the slot 311 and electrically connected to the connection terminal 301.

Meanwhile, a mismatch prevention structure is preferably provided to the insert 310 and the metal housing 200 so as to prevent the upper and lower surfaces of the insert 310 from being erroneously inserted into the metal housing 200.

The mismatch prevention structure is provided to the insert 310 and the metal housing 200 with shapes corresponding to each other. For example, the mismatch prevention structure is provided as a guide projection and a mismatch prevention groove such that the guide projection is inserted into the mismatch prevention groove when the insert 310 is inserted into the metal housing 200. In more detail, as shown in FIG. 2, a mismatch prevention groove 313 is formed in the insert 310 in a direction along which the metal housing 200 is inserted, and a guide projection 213 is formed on the inner side of the metal housing 200 at a position corresponding to the mismatch prevention groove 313. Thus, when the inner housing 300 is inserted into the metal housing 200, the guide projection 213 is slid into the mismatch prevention groove 313.

Meanwhile, though it is illustrated that the mismatch prevention groove 313 is formed on the upper surface of the insert 310, the present invention is not limited thereto. Namely, it is also possible that the mismatch prevention groove 313 is formed in the lower surface of the insert 310, and the guide projection 213 is formed on the metal housing 200 at a position corresponding to the mismatch prevention groove 313. Also, it is also possible that a mismatch prevention groove is formed in the metal housing 200, and a guide projection is formed on the insert 310 at a position corresponding to the mismatch prevention groove. In other words, any structure capable of preventing the inner housing 300 from mismatching the metal housing 200 may be adopted.

The cover 320 is formed on an outer surface of the insert 310. In more detail, the cover 320 is formed along an outer periphery of the insert 310 at a front side and has a protruded shape outwards to surround a front outer side of the metal housing 200. In other words, the cover 320 is formed greater than a diameter of the outer periphery of the metal housing 200 and formed such that the front portion of the metal housing 200 is located between the cover 320 and the insert 310. Thus, if the inner housing 300 is coupled with the metal housing 200, the cover 320 supports the sealing 250 mounted to the outer periphery of the metal housing 200, so the sealing 250 is not moved or separated.

The cover 320 configured as above prevents the sealing 250 mounted to the metal housing 200 from moving due to a coupling work of the metal housing 200, and also prevents the inner housing 300 from being separated from the metal housing 200 due to vibrations.

In order to perform the above roles more easily, the coupling unit 330 is formed at the cover 320 such that the inner housing 300 is securely coupled to the metal housing 200. The coupling unit 330 has a coupling groove 332 corresponding to the coupling protrusion 232 for the coupling with the coupling protrusion 232.

Figure 7:
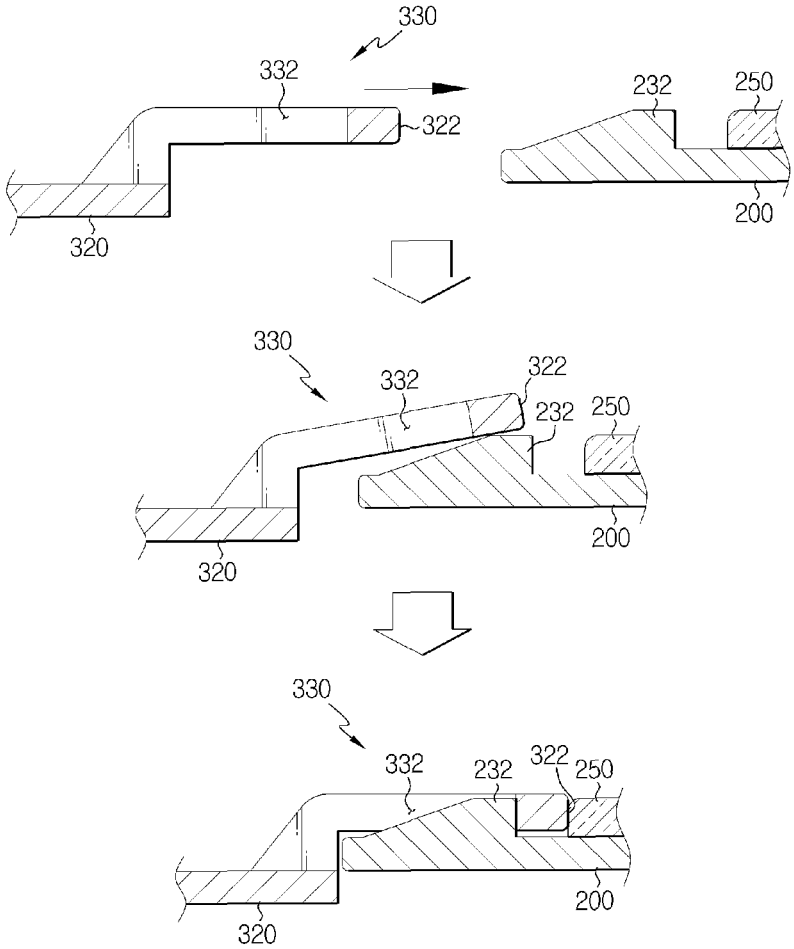
FIG. 7 is a perspective view showing that a coupling unit of the inner hosing of a shielded connector housing assembly according to a preferred embodiment of the present invention is inserted into a coupling protrusion.

The coupling unit 330 is elastically deformable, so the coupling protrusion 232 is inserted into the coupling groove 332 when the insert 310 is completely inserted into the metal housing 200. In more detail, as shown in FIG. 7, the coupling unit 330 is formed at a position respectively corresponding to the coupling protrusion 232 formed on the metal housing 200. Also, as the coupling unit 330 is cut into opposite sides to some extent from an end 322 of the cover 320, the coupling unit 330 is elastically deformable based on a portion connected with the cover 320. Thus, when the coupling protrusion 232 is inserted into the coupling groove 332, a lower portion of the coupling unit 330 is pressed due to the coupling protrusion 232 and thus elastically deformed upwards, and, if the coupling protrusion 232 is inserted into the coupling groove 332, the coupling unit 330 is restored to its original location. At this time, if the coupling unit 330 is coupled with the coupling protrusion 232, the end 322 of the cover 320 is contacted with the sealing 250, so the sealing 250 is supported not to be moved or separated.

Figure 8:
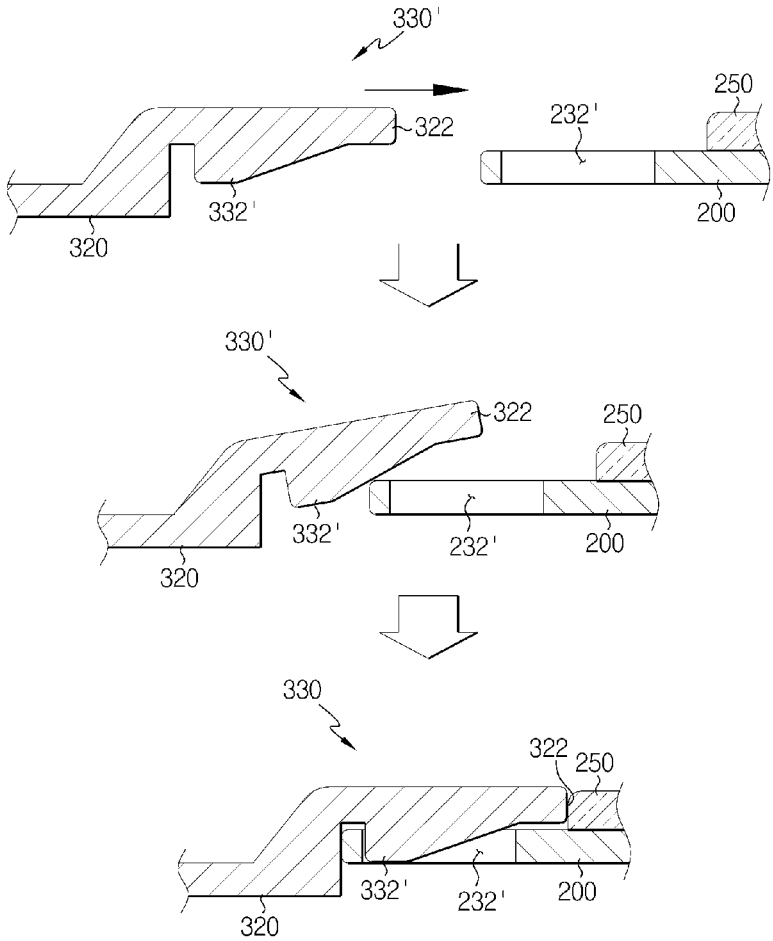
FIG. 8 is a perspective view showing that a coupling unit of the inner hosing of a shielded connector housing assembly according to another preferred embodiment of the present invention is inserted into a coupling protrusion.

Meanwhile, though it is illustrated that the coupling unit 330 has the coupling groove 332 and also the coupling protrusion 232 is formed on the metal housing 200 for the coupling with the coupling groove 332, the present invention is not limited thereto, but it is also possible to form a coupling protrusion on the coupling unit 330 and form a coupling groove in the metal housing 200. For example, as shown in FIG. 8, a coupling unit 330' having a coupling protrusion 332' is formed on the cover 320, and a coupling groove 232' is formed in the metal housing 200 for the coupling with the coupling protrusion 332'. At this time, the coupling protrusion 332' is formed at an inner side of the cover 320. In more detail, the coupling unit 330' is formed at a location respectively corresponding to the coupling groove 232' formed in the metal housing 200, and, as the coupling unit 330' is cut into opposite sides of the coupling protrusion 332' to some extent from the end 322 of the cover 320, the coupling unit 330' is elastically deformable based on a portion connected with the cover 320. Thus, when the coupling protrusion 332' is inserted into the coupling groove 232', the coupling protrusion 332' is pressed from the outer side of the metal hosing 200 and thus elastically deformed upwards. Also, if the coupling protrusion 332' is inserted into the coupling groove 232'. the coupling unit 330' is restored to its original location. At this time, if the coupling unit 330' is coupled with the coupling groove 232', the end 322 of the cover 320 is contacted with the sealing 250 and thus supports the sealing 250 not to be separated.

Additionally, deformation prevention grooves 321 are formed in both sides of the cover 320 such that the elastic contact pieces 100 installed to both front sides 207 of the metal housing 200 is exposed outwards. In other words, the deformation prevention grooves 321 are formed at locations corresponding to the mount portions 210 of the metal housing 200 and formed in correspondence with the elastic contact pieces 100. Thus, when the inner housing 300 is coupled to the metal housing 200, elastic parts of the elastic contact pieces 100 are exposed out of the cover 320. Since the counterpart metal housing 23 of the counterpart shielded connector 20 is coupled to surround a front outer periphery of the metal housing 200 into which the inner housing 300 is inserted, the above configuration helps the elastic parts 120 to be contacted with the inner side of the counterpart metal housing 22. Thus, the elastic contact pieces 100 make the metal housing 200 be electrically connected with the counterpart metal housing 22. The deformation prevention groove 321 configured as above is used for preventing plastic deformation of the clip-type elastic contact piece 100, as explained later in detail.

The outer housing 400 is coupled with the metal housing 200 to surround the inner housing 300 and the metal housing 200. Also, the outer housing 400 is coupled with the counterpart shielded connector 20 and made of insulating material. Here, the outer housing 400 is securely coupled with the metal housing 200 by means of a coupling unit 410. The coupling unit 410 is elastically deformable and coupled with a projection 242 formed at a rear side of the metal housing 200. This coupling structure is substantially identical to the coupling structure between the coupling protrusion 232 of the metal housing 200 and the coupling unit 330 formed at the cover 320, so it is not explained in detail here.

Meanwhile, if the outer housing 400 is coupled to the metal housing 200, the metal housing 200 and the outer housing 400 are placed as being spaced apart from each other by a predetermined distance. It is because the counterpart metal housing 22 is coupled to surround a front outer periphery of the metal housing 200 (see FIG. 6). In other words, the counterpart metal housing 22 is inserted between the metal housing 200 and the outer housing 400 and then connected to the metal housing 200.

Figure 9:
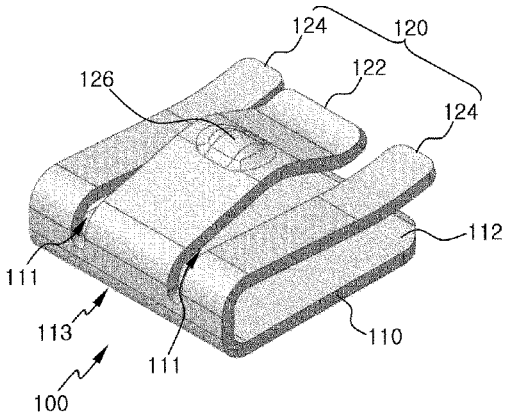
FIG. 9 is a perspective view showing a clip-type elastic contact piece according to the present invention.

Hereinafter, the clip-type elastic contact piece 100 is explained in detail with reference to FIG. 9.

The clip-type elastic contact piece 100 includes a flat plate 110 with a predetermined length and an elastic part 120 formed by bending one side of the flat plate 110 in a length direction of the flat plate 110. At this time, the bent portion of the flat plate 110 is called a 'bent portion 113'.

The flat plate 110 has an area corresponding to the mount portion 210, so a front side 112 of the flat plate 110 is mounted to come in contact with the mount portion 210 formed in the inner side of the metal housing 200. The elastic part 120 is mounted to come in contact with the mount portion 210 formed in the outer side of the metal housing 200. In other words, the flat plate 110 is formed in correspondence with the mount portion 210, and the elastic part 120 is contacted with the mount portion 210, so the elastic contact piece 100 may minimize shaking caused by vibrations of the shielded connector housing assembly 10.

The elastic part 120 is formed by bending the flat plate 110 with a predetermined length, so the elastic part 120 is elastically deformable. At this time, the elastic part 120 is spaced apart from the front side 112 of the flat plate 110. For example, a distance from the front side 112 of the flat plate 110 to the elastic part 120 is partially shorter than a thickness of the mount portion 210. Thus, if the elastic part 120 is opened and then the mount portion 210 is inserted between the elastic part 120 and the flat plate 110, the elastic part 120 elastically presses the mount portion 210. In other words, as the elastic part 120 elastically presses the mount portion 210, the clip-type elastic contact piece 100 may be stably installed to the mount portion 210.

Meanwhile, the elastic part 120 may be provided in plural. For example, a plurality of slits 111 are formed in a length direction of the elastic part 120, and the elastic part 120 is partitioned by means of the slits 111. In more detail, the elastic piece 120 is composed of a contact elastic part 122 formed at the center of the elastic piece 12 to contact with a counterpart metal housing 22 (see FIG. 5) of a counterpart shielded connector 20 (see FIG. 5) and two mount elastic parts 124 partitioned by slits 111 formed in both sides of the contact elastic part 122.

The contact elastic part 122 becomes more distant from the front side 112 of the flat plate 110 along the length direction of the flat plate 110 based on the bent portion 113 of the flat plate 110 and then gradually approaches the front side 112 of the flat plate 110 again after passing over the peak point. At this time, an end of the contact elastic part 122 gradually approaching the front side 112 of the flat plate 110 is formed to gradually approach the front side 112 of the flat plate 110 along the length direction of the flat plate 110 and is then separated from the front side 112 of the flat plate 110 after passing over the bottom point. Thus, when the shielded connector housing assembly 10 is coupled with the counterpart shielded connector 20, the contact elastic part 122 presses the counterpart metal housing 22 of the counterpart shielded connector 20 to electrically connect the metal housing 200 with the counterpart metal housing 22. If the coupling between the shielded connector housing assembly 10 and the counterpart shielded connector 20 is released, the contact elastic part 122 is restored to its original location. In other words, the peak point of the contact elastic part 122 is contacted with the counterpart metal housing 22, and the bottom point is contacted with the mount portion 210 to elastically restore the contact elastic part 122 to its original location.

Meanwhile, a projection 126 protruding in a direction opposite to the front side 112 of the flat plate 110 is formed at the peak point of the contact elastic part 122. In case the elastic contact piece 100 is used for a long time, the elastic restoring force of the contact elastic part 122 may be deteriorated, and in this case, stable contact between the contact elastic part 122 and the counterpart metal housing 22 may not be ensured. The projection 126 complements the elastic restoring force of the contact elastic part 122, which has been deteriorated due to the long time use of the elastic contact piece 100, thereby ensuring stable contact between the contact elastic part 122 and the counterpart metal housing 22.

The mount elastic part 124 allows the elastic contact piece 100 to be mounted to the mount portion 210 in a more stable way. In other words, the mount elastic part 124 is spaced apart from the front side 112 of the flat plate 110 based on the bent portion 113, and the spaced distance is set to be smaller than a thickness of the mount portion 210. For example, the mount elastic part 124 is configured to gradually approach the front side 112 of the flat plate 110 along the length direction of the flat plate 110 based on the bent portion of the flat plate 110. Thus, the mount elastic part 124 and the mount portion 210 of the flat plate 110 are pressed to face each other, thereby stably installing the elastic contact piece 100.

Meanwhile, the elastic contact piece 100 installed to the metal housing 200 may be plastically deformed due to physical impacts or excessive vibrations exerted thereto from the outside. Here, the elastic part 120 of the elastic contact piece 100 may be elastically deformed when a physical impact is applied toward the front side 112 of the flat plate 110, while, if a physical impact is applied to the side of the flat plate 110, namely perpendicular to the front side 112, the elastic part 120 is not restored to its original location but plastically deformed. Thus, the deformation prevention groove 321 of the inner housing 300, explained above, supports the side of the elastic piece 120 so as to prevent plastic deformation of the elastic contact piece 100. In more detail, the deformation prevention groove 321 is formed at a location corresponding to the elastic contact piece 100 installed at the mount portion 210 and has a width corresponding to the width of the elastic part 120. Also, deformation prevention groove 321 is partially concave such that the concave portion has a width corresponding to the width of the contact elastic part 122. In this way, the contact elastic part 122 is fit into the deformation prevention groove 321. Thus, the concave portion of the deformation prevention groove 321 supports a side of the contact elastic part 122 partially, so the deformation prevention groove 321 may prevent the contact elastic part 122 from being plastically deformed though an external physical impact or excessive vibration is applied to the contact elastic part 122.

Additionally, though it has been illustrated that the elastic contact piece 100 is partitioned into three parts by means of the slits 111, the present invention is not limited thereto, but the elastic contact piece may be composed of four or more elastic parts or just a single elastic part. In other words, the elastic contact piece 100 may adopt any structure that may be stably mounted to the mount portion 210 and contacted with the counterpart metal housing 22.

As a result, in the present invention, as the clip-type elastic contact piece 100 electrically connects the metal housing 200 of the shielded connector housing assembly 10 with the counterpart metal housing 22 of the counterpart shielded connector 20, the connection between the metal housing 200 and the counterpart metal housing 22 may be stably maintained, thereby ensuring long time durability. Also, since the elastic contact piece has a simple design capable of being easily attached to or detached from the metal housing 200, the clip-type elastic contact piece 100 may be easily fabricated and assembled.

In addition, in the shielded connector housing assembly 10 as described above, the inner housing 300 is coupled to surround the front outer periphery of the metal housing 200 such that the sealing 250 does not move, the metal housing 200 is coupled with the outer housing 400, and the counterpart metal housing 22 of the counterpart shielded connector 20 is inserted between the outer housing 400 and the metal housing 200 and tightly assembled thereto. In this way, it is possible to minimize shaking of each housing 200, 300, 400, 22 due to vibrations of a vehicle. Thus, abrasion among the housing may be prevented to improve vibration resistance. In addition, as the inner housing 300 is installed to the metal housing 200, the connection terminal 301 installed in the inner housing 300 may be stably connected to the connection pin 21. Moreover, since the inner housing 300, the metal housing 200 and the outer housing 400 are fabricated independently, so they may be easily prepared with simple structures.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

The clip-type elastic contact piece and the shielded connector housing assembly having the same according to the present invention, as explained above, give the following effects.

First, the elastic contact piece has a simple structure, so the elastic contact piece may be easily fabricated and also mounted to or separated from a metal housing in an easy and convenient way.

Second, it is possible to prevent abrasion of the metal housing and the elastic contact piece caused by excessive vibrations and contact. Thus, the metal housing and the elastic contact piece may ensure long time durability.

Third, since plastic deformation of the elastic contact piece is prevented, the connection between the metal housing and the counterpart metal housing may be stably maintained.

Fourth, the sealing mounted to the metal housing is not easily taken off to provide a stable waterproof function, and the connection of the connection terminal is stably maintained in spite of vibrations of a vehicle. Thus, it is possible to prevent abrasion of the connection terminal caused by vibrations and also to prevent deterioration of the connection terminal.

Fifth, the inner housing and the outer housing may be independently fabricated, which ensures easy production. Also, since the inner housing, the outer housing and the metal housing are tightly coupled, vibration resistance may be improved.

Sixth, the present invention may be applied all kinds of connectors that demand a shielded structure.

The invention claimed is:

1. A clip-type elastic contact piece, which is mounted to a mount portion formed at a metal housing of a shielded connector for the connection with a counterpart metal housing of a counterpart shielded connector to be coupled with the shielded connector, the clip-type elastic contact piece comprising:

a flat plate having a predetermined length; and an elastic part formed by bending one side of the flat plate in a length direction of the flat plate so as to be elastically deformable, the elastic part comprising:

two slits formed in a length direction thereof;

a contact elastic part formed between the slits, and elastically pressing the counterpart metal housing of the counterpart shielded connector to provide a secure electric connection between the metal housing and the counterpart metal housing when the shielded connector is coupled with the counterpart shielded connector; and mount elastic parts formed by the slits at both sides of the contact elastic part, respectively, and spaced apart from the flat plate based on the bent portion such that the spaced distance is partially smaller than a thickness of the mount portion, wherein the clip-type elastic contact piece is mounted to the mount portion in a manner that the mount elastic parts and the flat plate press the mount portion toward each other.

2. The clip-type elastic contact piece according to claim 1, wherein the contact elastic part is gradually distanced from the front side of the flat plate along the length direction of the flat plate based on the bent portion and the gradually approaches the front side of the flat plate again after passing over a peat point.

3. The clip-type elastic contact piece according to claim 2, wherein a projection is formed at the peat point of the contact elastic part and protrusive in a direction opposite to the front side of the flat plate.

4. A shielded connector housing assembly, comprising:

an inner housing into which a cable terminal is inserted;

a metal housing partially inserted into a counterpart metal housing, the metal housing having mount portions formed at both sides of a front portion thereof, the metal housing being coupled with the inner housing;

a clip-type elastic contact piece having a flat plate with a predetermined length and an elastic part formed by bending one side of the flat plate so as to be elastically deformable, the clip-type elastic contact piece being inserted into and mounted to the mount portions; and a sealing mounted to an outer periphery of the metal housing and inserted into the counterpart metal housing together with the metal housing, the seeing being closely adhered to an inner periphery of the counterpart metal housing to give a sealed structure when the metal housing is completely inserted into the counterpart metal housing, wherein the inner housing includes a cover formed at an outer side thereof to surround a front outer side of the metal housing such that the sealing inserted into the outer side of the metal housing is not taken off, wherein the elastic part is spaced apart from a front side of the flat plate based on the bent portion, and the spaced distance is partially smaller than a thickness of the mount portion.

5. The shielded connector housing assembly according to claim 4, wherein the inner housing further includes:

an insert having a slot to which a connection pin is coupled, the insert being inserted into the metal housing; and wherein the cover has a coupling unit to be coupled with the metal housing.

6. The shielded connector housing assembly according to claim 5, wherein the coupling unit has a coupling groove corresponding to a coupling protrusion formed on an outer side of the metal housing such that the coupling groove is coupled with the coupling protrusion, and wherein the coupling unit is elastically deformable such that the coupling protrusion is inserted into the coupling groove when the insert is completely inserted into the metal housing.

7. The shielded connector housing assembly according to claim 5, wherein the coupling unit has a coupling protrusion corresponding to a coupling groove formed in an outer side of the metal housing such that the coupling protrusion is coupled with the coupling groove, and wherein the coupling unit is elastically deformable such that the coupling protrusion is inserted into the coupling groove when the insert is completely inserted into the metal housing.

8. The shielded connector housing assembly according to claim 5, wherein the cover has a deformation prevention groove corresponding to the clip-type elastic contact piece so as to prevent plastic deformation of the clip-type elastic contact piece, and wherein the deformation prevention groove is formed to expose the clip-type elastic contact piece outwards.

9. The shielded connector housing assembly according to claim 4, wherein the elastic part has a plurality of slits formed in a length direction thereof such that the elastic part is partitioned into a contact elastic part and a mount elastic part.

10. The shielded connector housing assembly according to claim 9, wherein the elastic part has two slits formed in the length direction thereof such that the contact elastic part formed between the slits comes in contact with the counterpart metal housing of the counterpart shielded connector, and the mount elastic parts formed by the slits at both sides of the contact elastic part are spaced apart from the front side of the flat plate based on the bent portion such that the spaced distance is smaller than a thickness of the mount portion.

11. The shielded connector housing assembly according to claim 10, wherein the contact elastic part is gradually distanced from the front side of the flat plate along the length direction of the flat plate and then gradually approaches the front side of the flat plate after passing a peak point.

12. The shielded connector housing assembly according to claim 11, wherein the contact elastic part has a projection formed at the peak point and protruding in a direction opposite to the front side of the flat plate.

13. The shielded connector housing assembly according to claim 5, wherein a mismatch prevention structure is respectively provided to the insert and the metal housing so as to prevent the insert from being erroneously inserted into the metal housing.

14. The shielded connector housing assembly according to claim 13, wherein the mismatch prevention structure includes a guide projection and a mismatch prevention groove corresponding to each other, and the guide projection is inserted into the mismatch prevention groove when the insert is inserted into the metal housing.

* * * * *